US009810506B2

(12) United States Patent
Curry

(10) Patent No.: US 9,810,506 B2
(45) Date of Patent: Nov. 7, 2017

(54) SELF-CAPTURED DETENT MECHINISM

(71) Applicant: Smith & Wesson Corp., Springfield, MA (US)

(72) Inventor: Brett Curry, Monson, MA (US)

(73) Assignee: Smith & Wesson Corp., Springfield, MA (US)

( * ) Notice: Subject to any disclaimer, the term of this patent is extended or adjusted under 35 U.S.C. 154(b) by 168 days.

(21) Appl. No.: 14/994,773

(22) Filed: Jan. 13, 2016

(65) Prior Publication Data

US 2017/0199005 A1 Jul. 13, 2017

(51) Int. Cl.
*F41C 3/14* (2006.01)

(52) U.S. Cl.
CPC ..... *F41C 3/14* (2013.01)

(58) Field of Classification Search
CPC ..... F41C 3/14
USPC ..... 42/62, 67; 403/328, 325
See application file for complete search history.

(56) References Cited

U.S. PATENT DOCUMENTS 702,607 A * 6/1902 Wesson ..... F41C 3/14 42/62
1,049,105 A * 12/1912 Key ..... F41A 15/02 42/59
1,141,256 A * 6/1915 Nelson ..... F41A 9/18 42/21
1,334,154 A * 3/1920 Harrison ..... B25B 23/0014 24/265 B
1,362,478 A * 12/1920 Deitrich ..... F41A 17/52 42/43
1,411,800 A * 4/1922 Molloy ..... F41A 3/04 42/32
1,583,617 A * 5/1926 Smith ..... F41A 17/52 42/41
1,624,876 A * 4/1927 Smith ..... F41A 17/52 42/1.04
1,925,174 A * 9/1933 Cremean ..... F16B 21/08 140/124
1,930,864 A * 10/1933 Schmeisser ..... F41A 17/52 42/1.01

(Continued)

FOREIGN PATENT DOCUMENTS

WO 2015200588 12/2015

OTHER PUBLICATIONS

Young, Lee W.; PCT International Search Report and Written Opinion regarding International Application No. PCT/US17/13325, May 5, 2017.

*Primary Examiner* — Michelle R Clement
*Assistant Examiner* — Bridget Cochran
(74) *Attorney, Agent, or Firm* — John A. Chionchio, Esquire; Ballard Spahr LLP

(57) ABSTRACT

A revolver has a detent mechanism providing positive mechanical engagement between the cylinder yoke and the frame. A housing mounted on the frame has a spring biased plunger that transversely engages a pin. The pin projects from the housing and engages a recess on the yoke when the revolver cylinder is closed. The pin is biased into engagement with the recess by the plunger to maintain the revolver closed and the chambers of the cylinder in precise alignment with the barrel during firing. Manual force applied to the cylinder can overcome the biasing force and permit the revolver to be opened and closed.

18 Claims, 5 Drawing Sheets

(56) References Cited

U.S. PATENT DOCUMENTS 2,122,415 A * 7/1938 Fraser ..... F41A 17/20 42/70.06
2,125,933 A * 8/1938 Lewis ..... F41A 17/52 42/70.05
2,382,676 A * 8/1945 Swartz ..... F41C 3/14 42/62
2,399,904 A * 5/1946 Baucum ..... F41A 9/85 224/239
2,407,696 A * 9/1946 Webster ..... F16D 71/00 74/527
2,455,990 A * 12/1948 Gaugler ..... F41A 17/52 42/70.06
2,465,699 A * 3/1949 Smith ..... F41A 17/52 42/70.06
2,478,892 A * 8/1949 Bistoff ..... F41A 17/52 42/70.06
2,809,565 A * 10/1957 O'Brien ..... F41A 19/39 89/13.05
2,821,040 A * 1/1958 Tatman ..... F41A 17/52 42/41
2,867,930 A * 1/1959 Niesp ..... F41A 17/52 42/41
2,875,545 A * 3/1959 Westmoreland ..... F41A 19/10 42/65
2,909,940 A * 10/1959 Dawkins ..... F16D 71/00 114/144 R
2,914,877 A * 12/1959 Willenbacher ..... F41A 17/52 42/70.06
2,926,445 A * 3/1960 Green ..... F41A 3/66 42/17
3,006,096 A * 10/1961 Green ..... F41A 17/52 42/70.01
3,212,489 A * 10/1965 Merz ..... F41B 11/54 124/36
3,234,679 A * 2/1966 Benson ..... F41A 3/24 42/16
3,251,153 A * 5/1966 Mittelsteadt ..... F41A 19/53 42/65
3,257,749 A * 6/1966 Donaldson ..... F41A 3/42 42/16
3,270,456 A * 9/1966 Benson ..... F41A 3/24 42/16
3,397,640 A * 8/1968 Ziemba ..... F42C 9/06 102/243
3,685,193 A * 8/1972 Sefried, II ..... F41C 3/14 42/59
3,783,545 A * 1/1974 Sefried, II ..... F41C 9/08 42/59
3,813,804 A * 6/1974 Ruger ..... F41C 3/14 42/59
3,830,001 A * 8/1974 Sefried, II ..... F41C 9/08 42/59
4,042,305 A * 8/1977 Vincent ..... F16B 21/088 15/104.33
4,091,557 A * 5/1978 Murabito ..... F41A 17/00 42/66
4,422,433 A * 12/1983 Milliman ..... F41A 9/28 124/44.7
4,449,312 A * 5/1984 Ruger ..... F41A 17/74 42/66
4,614,457 A * 9/1986 Sammon ..... B25B 23/0014 403/322.2
4,651,456 A * 3/1987 Ghisoni ..... F41A 19/53 42/59
4,669,324 A * 6/1987 deMey ..... F16H 25/183 403/328
4,811,511 A * 3/1989 Beretta ..... F41A 19/15 42/42.01
4,845,870 A * 7/1989 Vernon ..... F41A 17/74 42/66
4,934,081 A * 6/1990 Mooney ..... F41C 3/14 267/179
4,964,232 A * 10/1990 Mainland ..... F41A 3/58 42/44
5,160,795 A * 11/1992 Milliman ..... F41A 19/53 124/48
5,463,829 A * 11/1995 Sprangers ..... F41A 19/14 42/42.01
5,615,507 A * 4/1997 French ..... F41A 17/28 42/69.02
5,787,629 A * 8/1998 Campbell ..... F41C 23/00 42/85
6,006,632 A * 12/1999 Hsieh ..... B25B 23/0021 403/322.1
6,062,112 A * 5/2000 Bonniot ..... B25B 23/0021 403/328
6,266,908 B1 * 7/2001 Spencer ..... F41A 21/485 42/71.02
6,360,469 B1 * 3/2002 Mikuta ..... F41A 17/066 42/70.11
6,823,762 B2 * 11/2004 Hu ..... B25B 23/0035 403/322.2
6,907,687 B2 * 6/2005 Rousseau ..... F41A 3/58 42/75.02
7,059,075 B1 * 6/2006 Curry ..... F41C 3/14 42/62
7,156,084 B1 * 1/2007 Landis ..... F41B 11/00 124/50
7,263,795 B1 * 9/2007 Curry ..... F41A 15/02 42/64
7,328,645 B1 * 2/2008 Curry ..... F41A 21/28 42/1.06
7,448,823 B2 * 11/2008 Silva ..... F16G 15/06 403/325
7,743,543 B2 * 6/2010 Karagias ..... F41A 19/10 42/16
7,861,449 B1 * 1/2011 Zajk ..... F41A 3/66 42/62
7,895,924 B2 * 3/2011 Hsieh ..... B25B 15/001 81/177.85
8,327,568 B1 * 12/2012 Lavergne ..... F41A 9/70 42/71.01
8,353,124 B1 * 1/2013 Zukowski ..... F41C 3/14 42/76.02
8,434,255 B2 * 5/2013 Kefer ..... F41A 3/58 42/69.01
8,549,782 B2 10/2013 Curry
8,789,303 B2 7/2014 Curry
9,476,660 B2 * 10/2016 Potter ..... F41A 17/52
2002/0148152 A1 * 10/2002 Curry ..... F41A 17/74 42/66
2006/0191182 A1 * 8/2006 Curry ..... F41A 17/02 42/70.04
2006/0207147 A1 * 9/2006 Lazor ..... F41A 17/48 42/41
2006/0242878 A1 * 11/2006 Dubois ..... F41A 3/74 42/59
2010/0170129 A1 * 7/2010 Curry ..... F41C 3/14 42/66
2013/0074391 A1 * 3/2013 Curry ..... F41A 17/72 42/70.08
2013/0111796 A1 * 5/2013 Dionne ..... F41A 17/00 42/70.11
2013/0174459 A1 * 7/2013 Moretti ..... F41A 17/60 42/69.01
2014/0331536 A1 11/2014 Curry
2015/0096212 A1 * 4/2015 Curry ..... F41A 17/36 42/16

* cited by examiner

SELF-CAPTURED DETENT MECHINISM

FIELD OF THE INVENTION

This invention relates to detent mechanisms and to revolvers using detent mechanisms.

BACKGROUND

Revolvers having a swing-out cylinder have withstood the test of time because they permit ease of loading and ejecting cartridges without compromising the strength of the frame. Such revolvers present special design challenges, in particular, challenges concerning the use of detent mechanisms to maintain the revolver in a closed configuration. The mechanism must be robust and reliable; it must maintain the revolver closed during firing yet allow it to be readily opened manually for ejecting spent cartridges and reloading. It is also advantageous if the detent mechanism helps to maintain precise alignment between cylinder and barrel. Ideally, the detent mechanism would be simple to make and assemble on the revolver frame.

SUMMARY

The invention concerns a detent mechanism. In one embodiment, the detent mechanism comprises a housing. A pin bore is positioned within the housing. The pin bore extends longitudinally along a pin bore axis. A plunger cavity is positioned within the housing and intersects the pin bore. The plunger cavity extends longitudinally along a plunger cavity axis. The plunger cavity axis is oriented transversely to the pin bore axis. A pin has a tip. The pin is positioned within the pin bore and movable along the pin bore axis between a first position, wherein the tip projects from the housing, and a second position, wherein the tip is within the housing. An action surface is positioned on the pin. The action surface is oriented transversely to the pin bore axis. A plunger has an end. The plunger is positioned within the plunger cavity and is movable along the plunger cavity axis. A spring is positioned within the plunger cavity and biases the end of the plunger into engagement with the action surface of the pin.

In a particular example embodiment, the plunger cavity comprises an open end terminating on a surface of the housing, and a closed end terminating within the housing. The spring is positioned between the closed end and the plunger in this example.

In a specific example, the tip comprises a conical surface. By way of further example, the pin comprises an end oppositely disposed to the tip. The end comprising a conical surface in an example embodiment By way of example, the pin has a round cross section. In a further example, the action surface has an orientation angle relative to the pin bore axis from 30° to 60°. In a specific example the action surface has an orientation angle relative to the pin bore axis of 45°. In an example embodiment the pin comprises a cylindrical body. Further by way of example, the action surface comprises a surface of a notch formed in the cylindrical body. In a specific example, the notch is V-shaped. Further by way of example, the plunger has a round cross section. In a specific example, the plunger comprises a cylindrical body. By way of example, the end of the plunger comprises at least one surface oriented angularly with respect to the plunger cavity axis. In an example embodiment, the at least one surface has an orientation angle relative to the plunger cavity axis from 30° to 60°. In a particular example, the at least one surface has an orientation angle relative to the plunger cavity axis of 45°. By way of further example, the end of the plunger comprises first and second surfaces oriented angularly with respect to the plunger cavity axis.

The invention also encompasses a revolver. In an example embodiment the revolver comprises a frame. A yoke is mounted on the frame. The yoke is movable about a pivot axis between an open and a closed position. A recess is positioned within the yoke. A cylinder is mounted on the yoke. A detent mechanism comprises a housing mounted on the frame adjacent to the yoke. A pin bore is positioned within the housing. The pin bore extends longitudinally along a pin bore axis. A plunger cavity is positioned within the housing and intersects the pin bore. The plunger cavity extends longitudinally along a plunger cavity axis. The plunger cavity axis is oriented transversely to the pin bore axis. A pin having a tip is positioned within the pin bore. The pin is movable along the pin bore axis between a first position, wherein the tip projects from the housing and engages the recess when the yoke is in the closed position, and a second position, wherein the tip is within the housing. An action surface is positioned on the pin. The action surface is oriented transversely to the pin bore axis. A plunger has an end. The plunger is positioned within the plunger cavity and movable along the plunger cavity axis. A spring is positioned within the plunger cavity. The spring biases the end of the plunger into engagement with the action surface of the pin.

In an example revolver the plunger cavity comprises an open end terminating on a surface of the housing and a closed end terminating within the housing. The spring is positioned between the closed end and the plunger. By way of example, the open end faces the yoke when the yoke is in the closed position. In a further example, the pin bore axis is parallel to the pivot axis. In a specific example, the tip comprises a conical surface. Still further by way of example, the pin comprises an end oppositely disposed to the tip, the end comprising a conical surface in this example. In an example embodiment the pin has a round cross section. In a particular example, the action surface has an orientation angle relative to the pin bore axis from 30° to 60°. In a specific example, the action surface has an orientation angle relative to the pin bore axis of 45°.

In an example embodiment, the pin comprises a cylindrical body. Further by way of example, the action surface comprises a surface of a notch formed in the cylindrical body. In an example embodiment, the notch is V-shaped. In another revolver example, the plunger has a round cross section. In a specific example, the plunger comprises a cylindrical body. Further by way of example, the end of the plunger comprises at least one surface oriented angularly with respect to the plunger cavity axis. In a particular example embodiment, the at least one surface has an orientation angle relative to the plunger cavity axis from 30° to 60°. In a specific example embodiment, the at least one surface has an orientation angle relative to the plunger cavity axis of 45°. By way of further example, the end of the plunger comprises first and second surfaces oriented angularly with respect to the plunger cavity axis.

DETAILED DESCRIPTION

Figure 1:
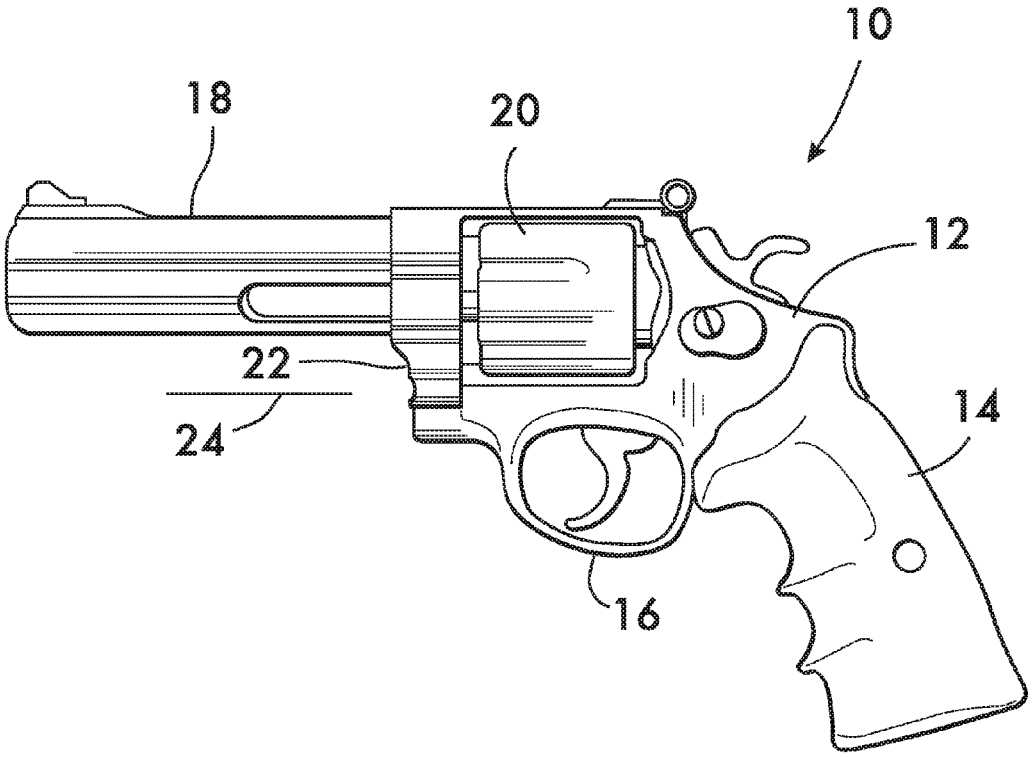
FIG. 1 is a left side view of an example revolver according to the invention in a closed configuration.
Figure 2:
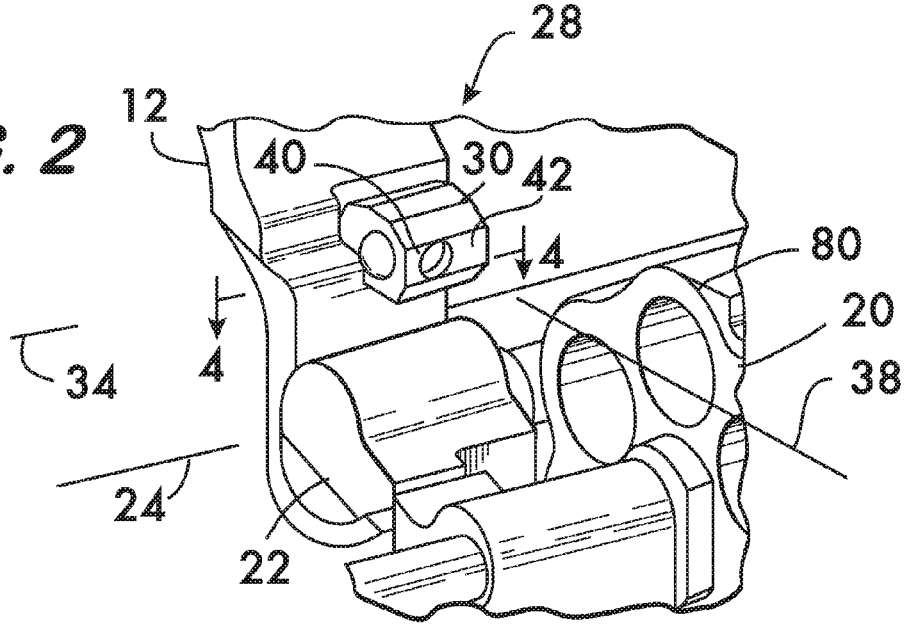
FIG. 2 is a partial isometric view of the revolver of FIG. 1 in an open configuration.
Figure 3:
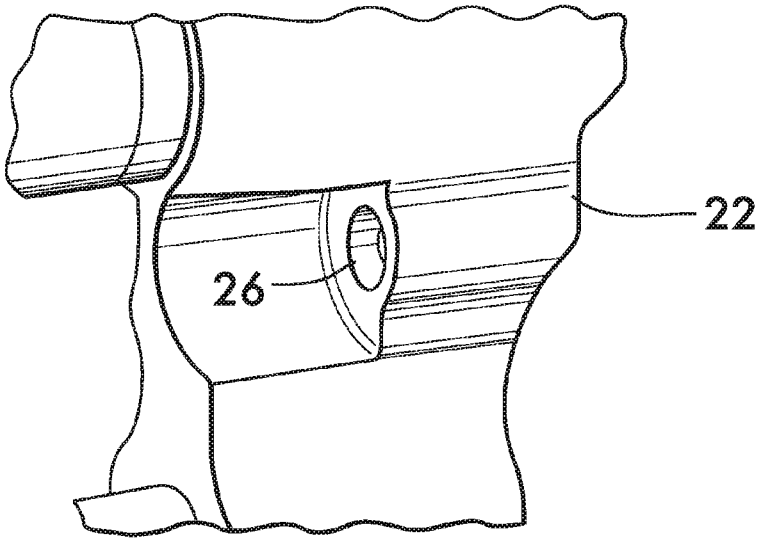
FIG. 3 is an isometric view of a component of the revolver shown in FIG. 1 as seen from the right side.

FIG. 1 shows an example revolver 10 comprising a frame 12 including a grip 14 and a trigger guard 16. A barrel 18 is attached to the frame. Revolver 10 is a "swing-out" type revolver and thus has a cylinder 20 mounted on a yoke 22. Yoke 22 is mounted on frame 12 and is moveable about a pivot axis 24 between a closed position (FIG. 1) and an open position (FIG. 2). FIG. 3 shows a reverse view of yoke 22, the yoke having a recess 26, described in more detail below.

Figure 4:
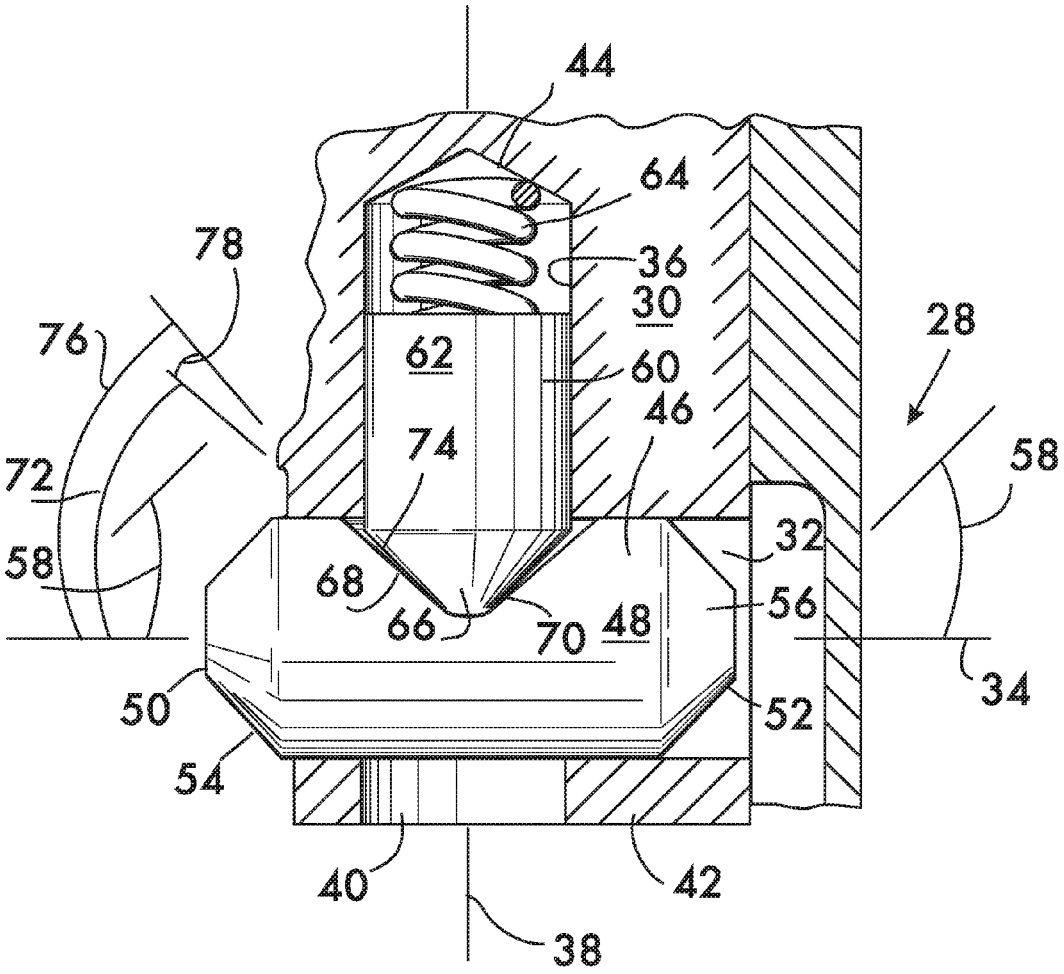
FIG. 4 is sectional views taken at line 4-4 in FIG. 2.

FIGS. 2 and 4 show an example detent mechanism 28. Detent mechanism 28 comprises a housing 30 mounted on frame 12 adjacent to yoke 22. A pin bore 32 is positioned within the housing 30. Pin bore 32 extends longitudinally along a pin bore axis 34. In this example the pin bore axis 34 is parallel to the pivot axis 24 of yoke 22. A plunger cavity 36 is also positioned within housing 30. Plunger cavity 36 intersects the pin bore 32 and extends along a plunger cavity axis 38 which is oriented transversely to the pin bore axis 34. In this example the plunger cavity axis 38 and the pin bore axis 32 are at right angles to one another. Further by way of example the plunger cavity 36 comprises an open end 40, which terminates on a surface 42 of housing 30, and a closed end 44 terminating within the housing.

As shown in FIGS. 2 and 4, a pin 46 is positioned within the pin bore 32. In this example, pin 46 has a round cross section and comprises a cylindrical body 48 having a tip 50 and an oppositely disposed end 52. By way of example, both tip 50 and opposite end 52 comprise respective conical surfaces 54 and 56. Conical surfaces 54 and 56 have cone angles 58 from about 30° to about 60° as measured relatively to the pin bore axis 34. A cone angle of about 45° is considered advantageous. Other shapes for tip 50 and opposite end 52, such as a hemispherical shape, are also feasible.

Figure 5:
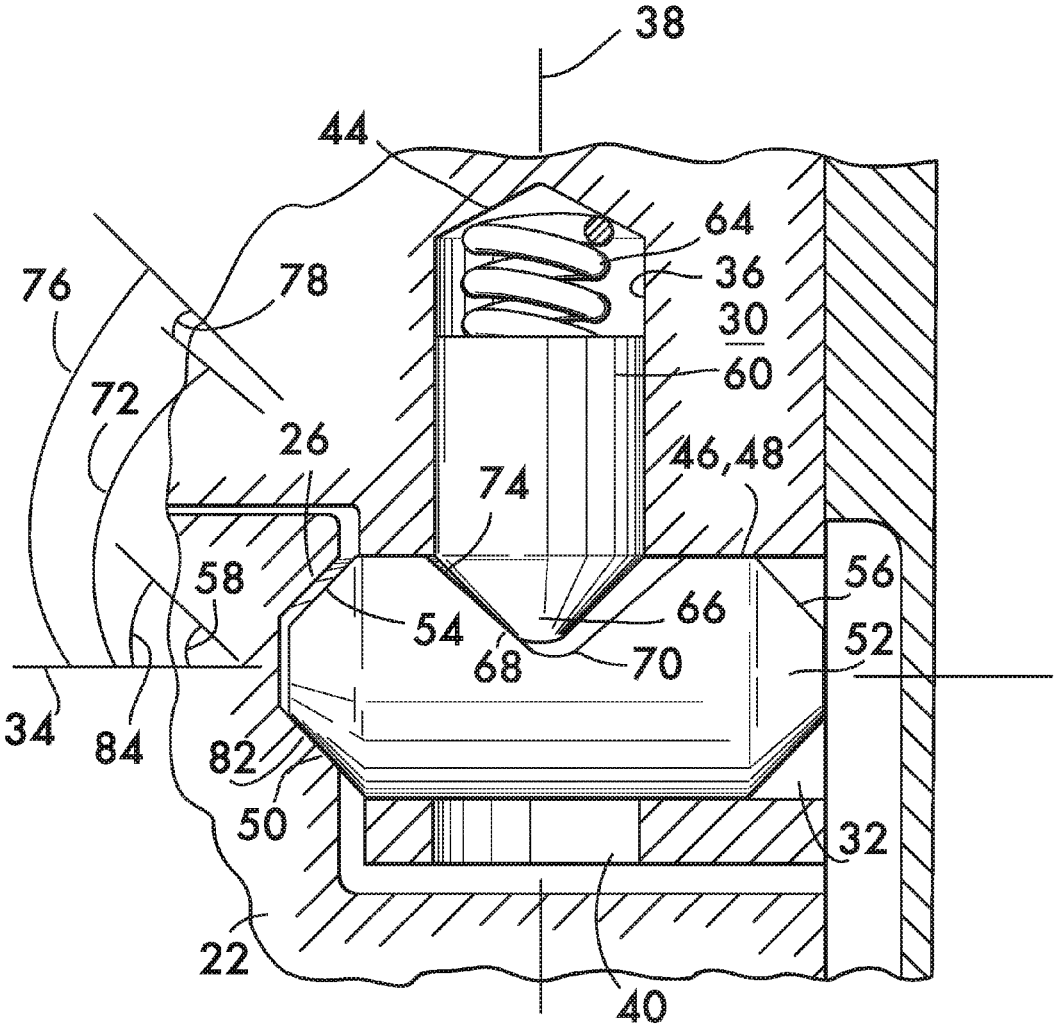
FIGS. 5 and 6 are sectional views illustrating operation of an example detent according to the invention.
Figure 6:
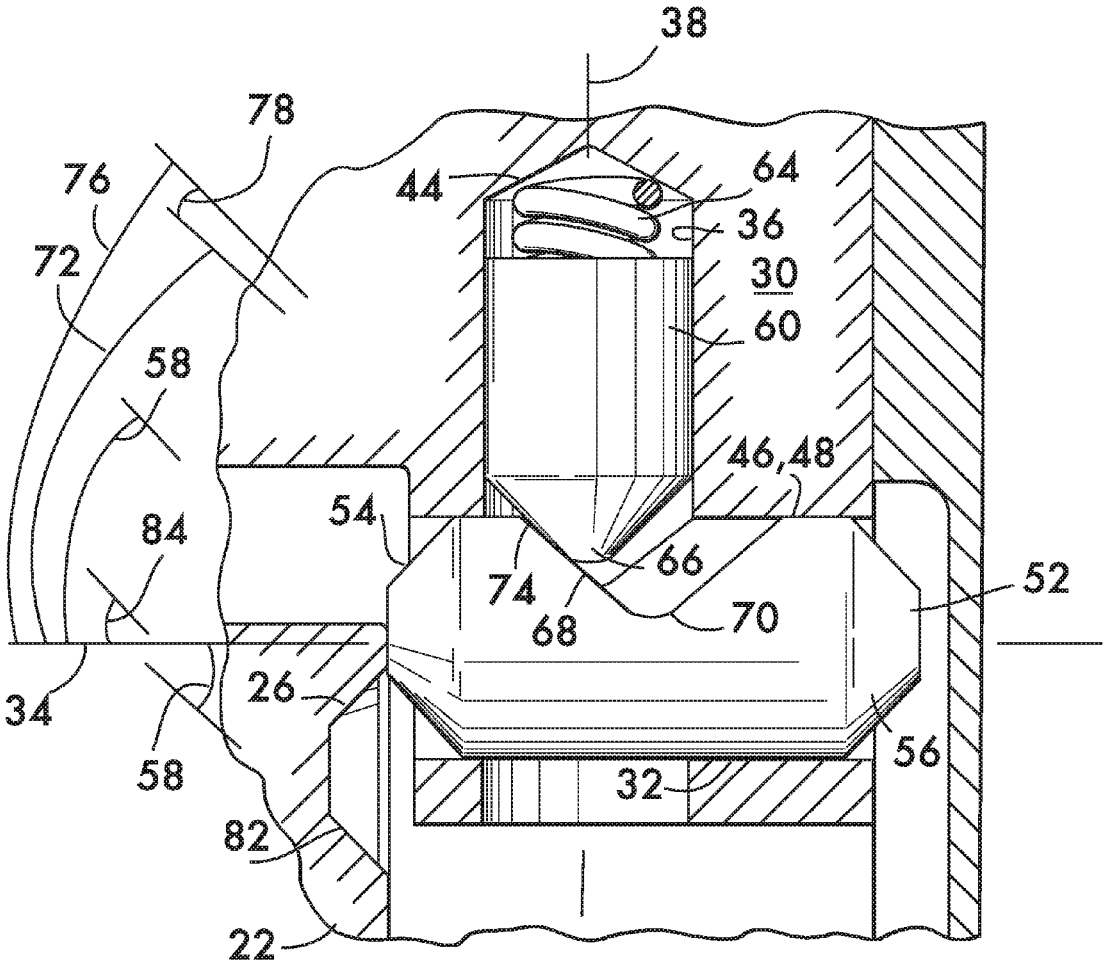

As illustrated in FIGS. 5 and 6, pin 46 is movable along pin bore axis 34 between a first position (FIGS. 2 and 5) wherein tip 50 projects from housing 30, and a second position (FIG. 6) wherein the tip 50 is within the housing 30. When yoke 22 is in the closed position of FIG. 1, pin 46 is in the first position with tip 50 projecting from housing 30 and engaging the recess 26 in the yoke 22 (see FIGS. 3 and 5). Pin 46 thus acts as a detent to retain the yoke 22 in the closed position. When pin 46 is moved along pin bore axis 34 to the second position (FIG. 6) it allows the yoke 22 to pivot about axis 24 into the open position of FIG. 2 to permit loading, unloading, or ejection of spent cartridges from the cylinder 20. Note that in this example, housing 30 is arranged so that the open end 40 of the plunger cavity 36 faces yoke 22 when the yoke is in the closed position, as may be inferred from FIGS. 1 and 2.

Motion of pin 46 between the first and second positions shown in FIGS. 5 and 6 is governed by its interaction with a plunger 60. As shown in FIG. 4, plunger 60 is positioned within the plunger cavity 36 and is movable along plunger cavity axis 38. In this example plunger 60 has a round cross section and comprises a cylindrical body 62. Plunger 60 is biased toward the open end 40 of plunger cavity 36 by a spring 64 positioned between the plunger 60 and the closed end 44 of the plunger cavity 36. Spring 64 in this example is a coil spring, but other types of springs are also feasible.

Plunger 60 has an end 66 which is biased by spring 64 into engagement with an action surface 68 positioned on pin 46. Action surface 68 is oriented transversely to the pin bore axis 34 and comprises a surface of a notch 70 formed in cylindrical body 48. In this example the notch 70 is a symmetrical "V"-shaped notch and may be considered to have two action surfaces 68, but other notch shapes are feasible. One or both action surfaces 68 are angularly oriented with respect to the pine bore axis 34 and have an orientation angle 72 from about 30° to about 60°, with an orientation angle of about 45° being advantageous. In a practical design, end 66 of plunger 60 which engages action surfaces 68 comprises at least one end surface 74 angularly oriented with respect to the plunger cavity axis 38. End surface 74 has an orientation angle 76 from about 30° to about 60°, with an orientation angle of about 45° being advantageous. To ensure cooperation between the end 66 of plunger 60 and the action surfaces 68 of pin 46 during assembly of the detent mechanism 28 it is advantageous to have two angularly oriented end surfaces 74 on the plunger 60. As shown in the example embodiment of FIG. 4, end 66 of plunger 60 has two end surfaces 74 arranged symmetrically. It is further advantageous that there be a difference in the orientation angles 72 of the action surfaces 68 as compared with the orientation angles 76 of the end surfaces 74 as shown in FIG. 4. Angular differences 78 from about 1° to about 3° are considered practical.

Assembly of the detent mechanism 28 is simplified by the configuration of the pin bore 32 and plunger cavity 36 in housing 30. Spring 64 is first inserted into the plunger cavity 36 through its open end 40 followed by the plunger 60. Care is taken to align the plunger end surfaces 74 in facing relation with the pin bore axis 34. The pin 46 is then inserted into the pin bore 32 (from either end if the pin bore is a through bore open at both ends). Engagement between either the conical surface 54 of tip 50 of pin 46 or the conical surface 56 of the opposite end 52 of the pin 46 and one of the end surfaces 74 of plunger 60 will force the plunger toward the closed end 44 of the plunger cavity 36, compressing spring 64. The angular orientation of the engaging surfaces facilitates motion of the plunger 60 along the plunger cavity axis 38 as the pin 46 is moved along the pin bore axis 34. When the notch 70 of pin 46 aligns with the end 66 of plunger 60 spring 64 biases the plunger end surfaces 74 into engagement with the action surfaces 68 of pin 46 as shown in FIG. 4. The pin 46 is thus captured within the pin bore 32 by mechanical engagement with the plunger 60, biased into the notch 70 by spring 64. If the pin bore 32 is a through bore as shown in the example embodiment herein, then disassembly is possible using a punch, applied at one end of the pin bore, to force the pin 46 out of the opposite end of the pin bore. During disassembly, engagement between one of the action surfaces 68 on pin 46 and a plunger end surface 74 forces the plunger 60 toward the closed end 44 of plunger cavity 36, thereby removing the plunger end 66 from notch 70 and freeing the pin 46. The plunger 60 and spring 64 will then drop out of the housing 30 under gravity when it is inverted.

Operation of the detent mechanism 28 when used on revolver 10 is illustrated in FIGS. 5 and 6. As shown in FIG. 5, the yoke 22 is in the closed position (see also FIG. 1) wherein the tip 50 of pin 46 projects outwardly from housing 30 and engages the recess 26 in the yoke 22. Mechanical engagement between the pin 46 and recess 26 maintains the yoke 22 in the closed position so that the chambers 80 (see FIG. 2) of the cylinder 20 align with barrel 18 (see FIG. 1) during firing of the revolver. To prevent lost motion between the cylinder 20 and the frame 12 and thereby ensure that alignment between chambers 80 and barrel 18 is maintained at all times when the revolver is closed, the geometry and tolerances of the recess 26, pin 46 and plunger 60 are such that spring 64 biases plunger end surface 74 into engagement with pin action surface 68 so as to force conical surface 54 of tip 50 of pin 46 into engagement with a surface 82 of recess 26. Surface 82 is advantageously angularly oriented with respect to pin bore axis 34 at an orientation angle 84 that matches the cone angle 58 of tip 50.

When it is desired to open the revolver 10, as shown in FIG. 2, force is applied to the right side of the cylinder 20 relative to the frame 12. The force results in a torque being applied about pivot axis 24 of the yoke 22. As the yoke begins to pivot (compare FIGS. 5 and 6) interaction between surface 82 of the recess 26 and the conical surface 54 of tip 50 of pin 46 forces the pin 46 out of engagement with the recess 26. The relative angular orientations of conical surface 54 and recess surface 82 forces the pin 46 to move along pin bore axis 34 and out of engagement with recess 26 (FIG. 6) allowing the yoke 22 and cylinder 20 to pivot from the closed (FIG. 1) to the open position (FIG. 2). Motion of the pin 46 along pin bore axis 34 is resisted by the spring biased plunger 60, whose end surface 74 acts against the action surface 68 of pin 46. However, the orientation angles of the end surface 74 and action surface 68 along with the spring stiffness of spring 64 are arranged so that the degree of resistance countering motion of pin 46 is such that the revolver will open only when the force applied to the cylinder 20 achieves a minimum practical threshold. Otherwise the pin 46 remains engaged with recess 26 and prevents inadvertent and undesired opening of the revolver 10.

Revolvers having a detent mechanism according to the invention are expected to provide reliable operation with a simplified mechanism for maintaining the revolver closed with precise alignment between chamber and barrel.

What is claimed is:

1. A revolver, comprising:

a frame;

a yoke mounted on said frame and movable about a pivot axis between an open and a closed position, a recess being positioned within said yoke;

a cylinder mounted on said yoke;

a detent mechanism, comprising:

a housing mounted on said frame adjacent to said yoke;

a pin bore positioned within said housing, said pin bore extending longitudinally along a pin bore axis;

a plunger cavity positioned within said housing and intersecting said pin bore, said plunger cavity extending longitudinally along a plunger cavity axis, said plunger cavity axis being oriented transversely to said pin bore axis;

a pin having a tip, said pin being positioned within said pin bore and movable along said pin bore axis between a first position, wherein said tip projects from said housing and engages said recess when said yoke is in said closed position, and a second position, wherein said tip is within said housing;

an action surface positioned on said pin, said action surface being oriented transversely to said pin bore axis;

a plunger having an end, said plunger being positioned within said plunger cavity and movable along said plunger cavity axis;

a spring positioned within said plunger cavity and biasing said end of said plunger into engagement with said action surface of said pin.

2. The revolver according to claim 1, wherein said plunger cavity comprises an open end terminating on a surface of said housing and a closed end terminating within said housing, said spring being positioned between said closed end and said plunger.

3. The revolver according to claim 2, wherein said open end faces said yoke when said yoke is in said closed position.

4. The revolver according to claim 1, wherein said pin bore axis is parallel to said pivot axis.

5. The revolver according to claim 1, wherein said tip comprises a conical surface.

6. The revolver according to claim 5, wherein said pin comprises an end oppositely disposed to said tip, said end comprising a conical surface.

7. The revolver according to claim 1, wherein said pin has a round cross section.

8. The revolver according to claim 1, wherein said action surface has an orientation angle relative to said pin bore axis from 30° to 60°.

9. The revolver according to claim 1, wherein said action surface has an orientation angle relative to said pin bore axis of 45°.

10. The revolver according to claim 1, wherein said pin comprises a cylindrical body.

11. The revolver according to claim 10, wherein said action surface comprises a surface of a notch formed in said cylindrical body.

12. The revolver according to claim 11, wherein said notch is V-shaped.

13. The revolver according to claim 1, wherein said plunger has a round cross section.

14. The revolver according to claim 1, wherein said plunger comprises a cylindrical body.

15. The revolver according to claim 1, wherein said end of said plunger comprises at least one surface oriented angularly with respect to said plunger cavity axis.

16. The revolver according to claim 15, wherein said at least one surface has an orientation angle relative to said plunger cavity axis from 30° to 60°.

17. The revolver according to claim 15, wherein said at least one surface has an orientation angle relative to said plunger cavity axis of 45°.

18. The revolver according to claim 1, wherein said end of said plunger comprises first and second surfaces oriented angularly with respect to said plunger cavity axis.

* * * * *